US010661559B2

(12) United States Patent
Uematsu et al.

(10) Patent No.: US 10,661,559 B2
(45) Date of Patent: May 26, 2020

(54) LIQUID DISCHARGE APPARATUS

(71) Applicant: SEIKO EPSON CORPORATION, Tokyo (JP)

(72) Inventors: Hidekazu Uematsu, Fujimi-machi (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/532,692

(22) Filed: Aug. 6, 2019

(65) Prior Publication Data

US 2019/0358951 A1 Nov. 28, 2019

Related U.S. Application Data

(63) Continuation of application No. 15/711,050, filed on Sep. 21, 2017, now Pat. No. 10,414,157.

(30) Foreign Application Priority Data

Sep. 26, 2016 (JP) ..... 2016-186663

(51) Int. Cl.

| | |
|---|---|
| ***B41J 2/045*** | (2006.01) |
| ***B41J 2/14*** | (2006.01) |
| ***B41J 2/245*** | (2006.01) |
| ***B41J 2/255*** | (2006.01) |

(52) U.S. Cl.

CPC ..... *B41J 2/04521* (2013.01); *B41J 2/04541* (2013.01); *B41J 2/04548* (2013.01); *B41J 2/04581* (2013.01); *B41J 2/04588* (2013.01); *B41J 2/04593* (2013.01); *B41J 2/14233* (2013.01); *B41J 2/245* (2013.01); *B41J 2/14201* (2013.01); *B41J 2/255* (2013.01); *B41J 2002/14491* (2013.01)

(58) Field of Classification Search

CPC ..... B41J 2/04541; B41J 2/04581; B41J 2/04548; B41J 2/14201; B41J 2/175; B41J 2/04521; B41J 29/38; B41J 2/245; B41J 2/255

USPC ..... 347/5, 9, 10, 12, 14, 19, 58, 68

See application file for complete search history.

(56) References Cited

U.S. PATENT DOCUMENTS

| | | | | |
|---|---|---|---|---|
| 9,440,440 | B2 | 9/2016 | Date | |
| 10,414,157 | B2 * | 9/2019 | Uematsu | B41J 2/04521 |
| 2017/0320322 | A1 | 11/2017 | Kiji et al. | |

FOREIGN PATENT DOCUMENTS

| | | | |
|---|---|---|---|
| JP | 2016-093973 | A | 5/2016 |

* cited by examiner

*Primary Examiner* — Jannelle M Lebron

(74) *Attorney, Agent, or Firm* — Global IP Counselors, LLP

(57) ABSTRACT

A liquid discharge apparatus includes a liquid discharge head configured to discharge a liquid, a first wire and a second wire to which a first drive signal and a second drive signal for driving the liquid discharge head is respectively supplied, and a single relay substrate configured to relay the first drive signal and the second drive signal from the first wire and the second wire to the liquid discharge head. The single relay substrate includes a first connector configured to be connected to the first wire, a second connector configured to be connected to the second wire, and a relay connector configured to be connected to a head-side connector of the liquid discharge head. The relay connector outputs, to the head-side connector, the first drive signal supplied from the first wire to the first connector, and the second drive signal supplied from the second wire to the second connector.

10 Claims, 8 Drawing Sheets

| | SI[m] (b1, b2) | Ts1 | | Ts2 | |
|---|---|---|---|---|---|
| | | SLa [m] | SLb [m] | SLa [m] | SLb [m] |
| LARGE DOT | (1, 1) | H | L | H | L |
| MEDIUM DOT | (1, 0) | H | L | L | H |
| SMALL DOT | (0, 1) | L | H | H | L |
| NON-RECORD | (0, 0) | L | H | L | H |

LIQUID DISCHARGE APPARATUS

CROSS-REFERENCE TO RELATED APPLICATIONS

This is a continuation application of U.S. patent application Ser. No. 15/711,050 filed on Sep. 21, 2017. This application claims priority to Japanese Patent Application No. 2016-186663 filed on Sep. 26, 2016. The entire disclosure of U.S. patent application Ser. No. 15/711,050 and Japanese Patent Application No. 2016-186663 is hereby incorporated herein by reference.

BACKGROUND

1. Technical Field

The present invention relates to a liquid discharge apparatus.

2. Related Art

Liquid discharge apparatuses such as an ink jet printer perform print processing by driving discharge sections in a liquid discharge head and discharging liquid such as ink filled in cavities in the discharge sections to form an image on a recording medium. To increase the print processing speed, some of such liquid discharge apparatuses are provided with a liquid discharge head called a line head, which includes a plurality of discharge sections and extends to a range wider than a recording medium. Generally, line printers have more discharge sections in a liquid discharge head than liquid discharge apparatuses, such as serial printers, that perform print processing by reciprocating a liquid discharge head. Accordingly, line printers generally require greater electric power than serial printers to drive a liquid discharge head. For this reason, line printers generally use a plurality of wires to supply a liquid discharge head with drive signals for driving the liquid discharge head from a drive substrate on which a drive signal generation circuit for generating the drive signals is provided (see JP-A-2016-093973).

In the maintenance of a liquid discharge apparatus, for example, to replace a drive substrate, wires for supplying drive signals from the drive substrate to a liquid discharge head are inserted into or removed from the drive substrate. When the liquid discharge head includes many discharge sections and if many wires are used to supply the drive signals from the drive substrate to the liquid discharge head, a user may mistakenly insert or remove the wires into or from the drive substrate in the wire insertion or removal operation. Furthermore, having many wires for supplying the drive signals from the drive substrate to the liquid discharge head increases the labor of inserting or removing wires. Accordingly, in some cases, the many wires for supplying the drive signals from the drive substrate to the liquid discharge head decrease the maintenance performance such as the success rate and the work efficiency of maintaining the liquid discharge apparatus.

SUMMARY

An advantage of some aspect of the invention is that there is provided a technique for reducing the decrease in maintenance performance in supplying drive signals from a drive substrate to a liquid discharge head by using many wires.

A liquid discharge apparatus according to one application example includes a liquid discharge head configured to discharge a liquid, a first wire to which a first drive signal for driving the liquid discharge head is supplied, a second wire to which a second drive signal for driving the liquid discharge head is supplied, and a single relay substrate configured to relay the first drive signal and the second drive signal from the first wire and the second wire to the liquid discharge head. The single relay substrate includes a first connector configured to be connected to the first wire, a second connector configured to be connected to the second wire, and a relay connector configured to be connected to a head-side connector of the liquid discharge head. The relay connector outputs, to the head-side connector, the first drive signal supplied from the first wire to the first connector, and the second drive signal supplied from the second wire to the second connector.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
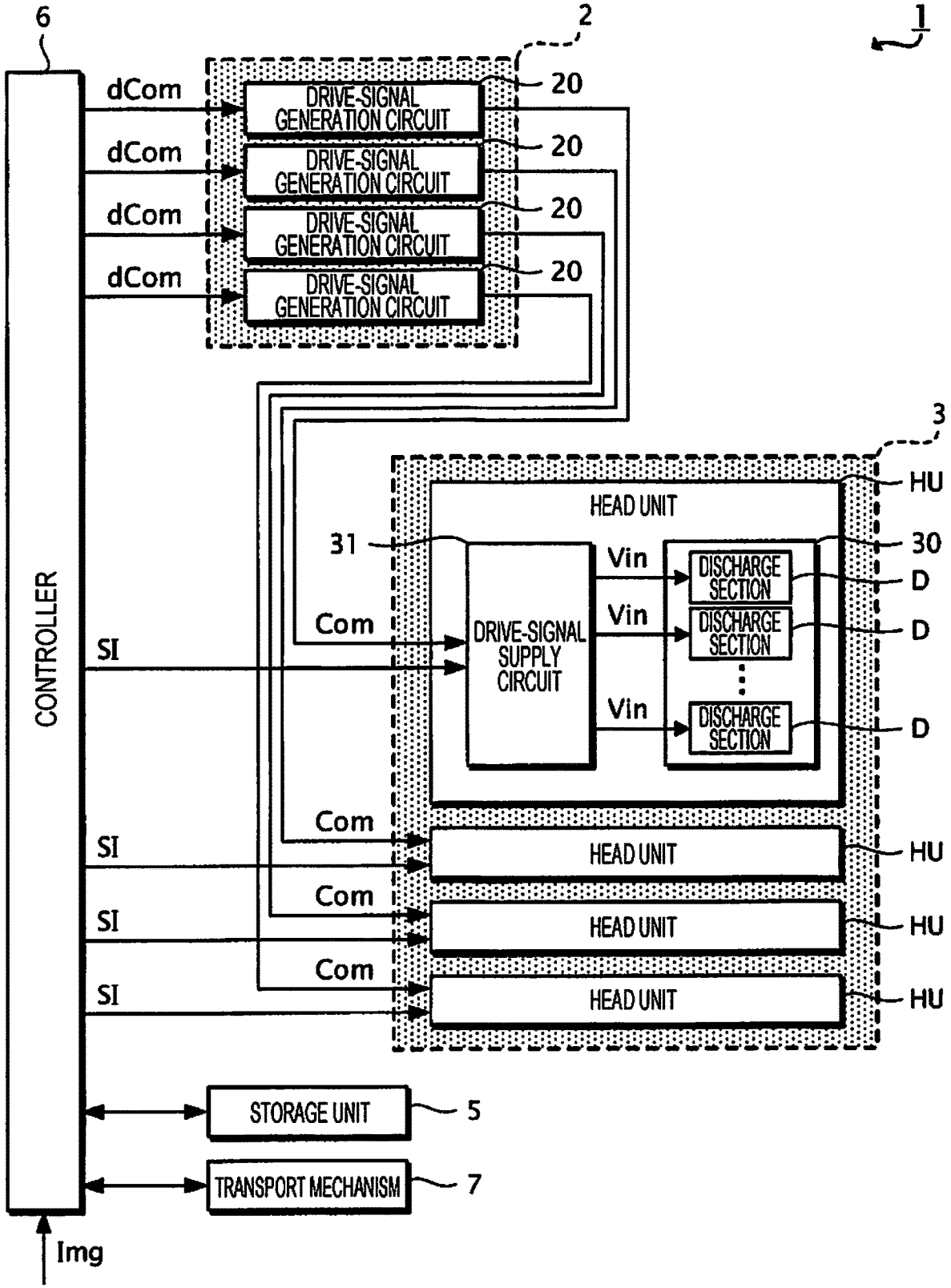
FIG. 1 is a block diagram of an ink jet printer according to an embodiment of the invention.

Hereinafter, embodiments of the invention will be described with reference to the drawings. In the drawings, the size and scaling ratio of each section are appropriately changed from those of actual sections. Although various technically preferred limitations are given in the embodiment described below in order to illustrate a specific preferred example of the invention, it should be noted that the scope of the invention is not intended to be limited to the embodiment unless such limitations are explicitly mentioned hereinafter.

A. Embodiment

As an example liquid discharge apparatus, this embodiment uses an ink jet printer that forms an image on recording paper P, which is an example "recording medium", by discharging ink, which is an example "liquid".

1. Outline of Ink Jet Printer

Figure 2:
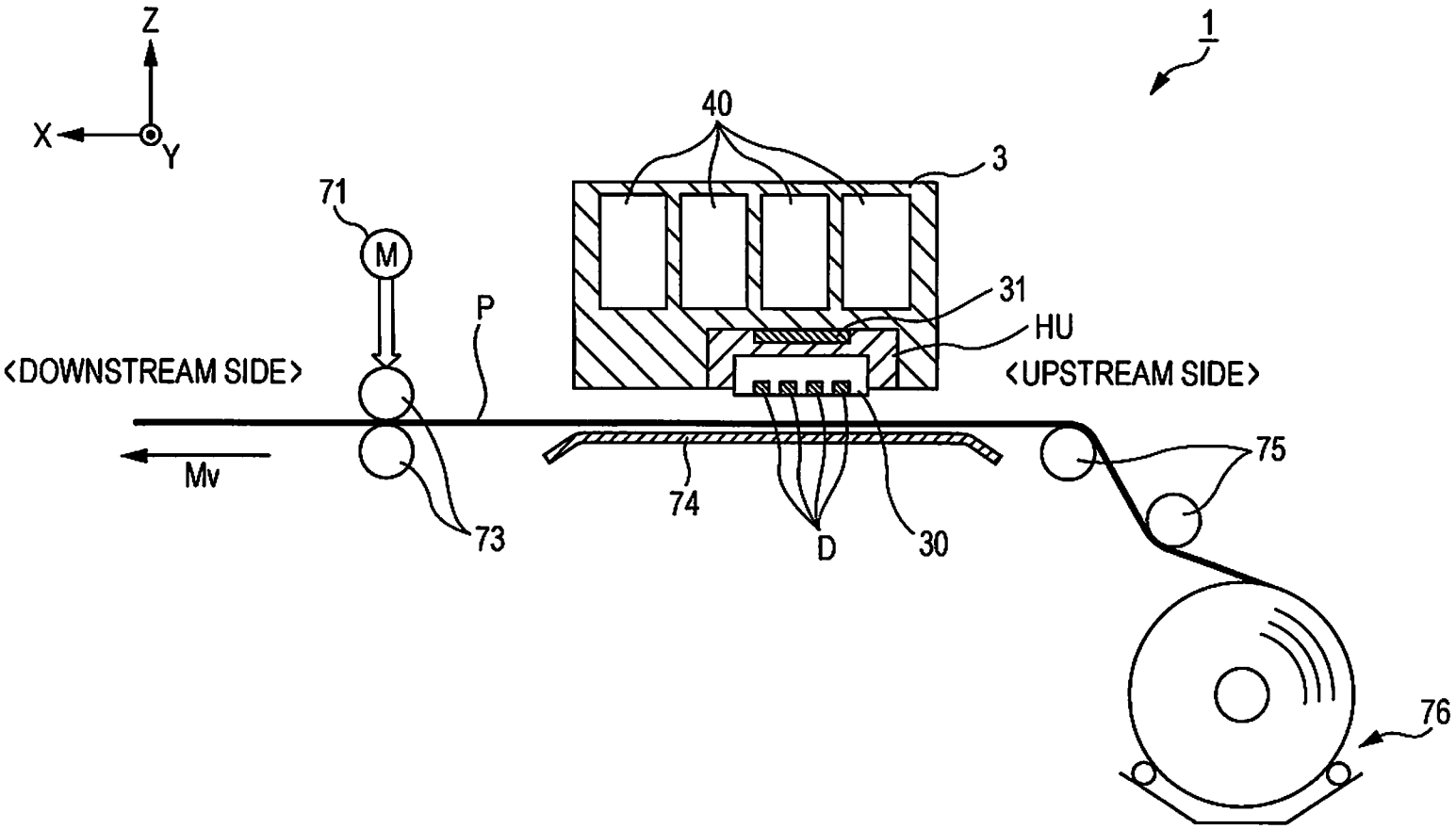
FIG. 2 is a partially sectional view schematically illustrating an inner structure of the ink jet printer.

With reference to FIG. 1 and FIG. 2, an ink jet printer 1 according to the embodiment will be described. FIG. 1 is a functional block diagram of the ink jet printer 1 according to the embodiment. FIG. 2 is a partially sectional view schematically illustrating an inner structure of the ink jet printer 1.

To the ink jet printer 1, from a host computer (not illustrated) such as a personal computer, a digital camera, or the like, print data Img that represents an image to be formed by the ink jet printer 1 is supplied. The ink jet printer 1 performs print processing for forming on recording paper P the image represented by the print data Img, which is supplied from the host computer. Although details will be described below, in this embodiment, it is assumed that the ink jet printer 1 is a line printer.

As illustrated in FIG. 1, the ink jet printer 1 includes a liquid discharge head 3, a controller 6, a drive-signal generation module 2 that has drive-signal generation circuits 20, a transport mechanism 7, and a storage unit 5. The liquid discharge head 3 includes head units HU that have discharge sections D for discharging ink. The controller 6 controls operations of the components in the ink jet printer 1. Each drive-signal generation circuit 20 generates a drive signal Com for driving the liquid discharge head 3, more specifically, the discharge sections D in the liquid discharge head 3. The transport mechanism 7 changes a relative position of the recording paper P with respect to the liquid discharge head 3. The storage unit 5 stores a control program for the ink jet printer 1 and other information. As illustrated in FIG. 1, in this embodiment, it is assumed that the liquid discharge head 3 includes four head units HU, and the drive-signal generation module 2 includes four drive-signal generation circuits 20 that correspond respectively to the four head units HU.

In this embodiment, each head unit HU includes a discharge module 30 that has M discharge sections D and a drive signal supply circuit 31 that switches between whether or not to supply the drive signal Com, which has been output by the drive-signal generation module 2, to the discharge module 30 (in this embodiment, M is a natural number that satisfies $1 \leq M$). In the description below, in order to distinguish each of the M discharge sections D provided in each discharge module 30, the discharge sections D may be referred to as a first stage, a second stage, . . . , M stage in order. The discharge section D in the m stage may be referred to as a discharge section D[m] (a variable m is a natural number that satisfies $1 \leq m \leq M$). A component, signal, and the like in the ink jet printer 1 that correspond to the number of the stage m of the discharge section D[m] may be expressed with a subscript [m] that is added to indicate that the component, signal, and the like correspond to the number of the stage m.

The storage unit 5 includes, for example, a volatile memory such as a random access memory (RAM) and a nonvolatile memory such as a read-only memory (ROM), electrically erasable programmable read-only memory (EEPROM), or a programmable ROM (PROM). The storage unit 5 stores various kinds of information such as the print data Img, which is supplied from a host computer, and a control program for the ink jet printer 1.

The controller 6 includes a central processing unit (CPU). Alternatively, instead of a CPU, the controller 6 may include a programmable logic device such as a field-programmable gate array (FPGA). The controller 6 controls each component in the ink jet printer 1 by enabling a control program that is stored in the storage unit 5 to be executed by the CPU in the controller 6. Specifically, the controller 6 generates a print signal SI for controlling each drive signal supply circuit 31, which is provided in the liquid discharge head 3, a waveform-designating signal dCom for controlling each drive-signal generation circuit 20, which is provided in the drive-signal generation module 2, and a signal for controlling the transport mechanism 7. The waveform-designating signal dCom is a digital signal for designating a waveform of a drive signal Com. The drive signal Com is an analog signal for driving the discharge sections D. The drive-signal generation circuit 20 includes a digital-to-analog (D/A) conversion circuit and generates the drive signal Com that has the waveform designated by the waveform-designating signal dCom. In this embodiment, it is assumed that the drive signal Com includes a drive signal Com-A and a drive signal Com-B. The print signal SI is a digital signal for designating the type of operation of the discharge sections D. Specifically, the print signal SI designates whether or not to supply the drive signal Com to the discharge section D to designate the type of operation of the discharge section D. Designating the type of operation of the discharge section D includes, for example, designating whether or not to drive the discharge sections D, designating whether or not to discharge ink from the discharge sections D when the discharge sections D are driven, and designating amounts of ink to be discharged from the discharge sections D when the discharge sections D are driven.

To perform print processing, the controller 6 instructs the storage unit 5 to store the print data Img supplied from a host computer. Then, in accordance with the various kinds of data stored in the storage unit 5 such as the print data Img, the controller 6 generates various control signals such as the print signal SI, the waveform-designating signal dCom, and the signal for controlling the transport mechanism 7. In accordance with the control signals and the various kinds of data stored in the storage unit 5, the controller 6 controls the transport mechanism 7 such that the relative position of the recording paper P with respect to the liquid discharge head 3 is changed and controls the liquid discharge head 3 such that the discharge sections D are driven. With these operations, the controller 6 determines whether or not to discharge ink from the discharge sections D, the discharge amount of ink, the timing for discharging the ink, and the like to control the print processing for forming an image corresponding to the print data Img on the recording paper P.

FIG. 2 is a partially sectional view schematically illustrating an inner structure of the ink jet printer 1. As illustrated in FIG. 2, in this embodiment, it is assumed that the ink jet printer 1 is provided with four ink cartridges 40. In FIG. 2, the ink cartridges 40 are provided in the liquid discharge head 3; however, the ink cartridges 40 may be provided at other locations in the ink jet printer 1. These four ink cartridges 40 correspond to four respective colors (CMYK) of cyan, magenta, yellow, and black. Each ink cartridge 40 is filled with an ink of a correspondingly assigned color.

As illustrated in FIG. 2, the transport mechanism 7 includes a transporting motor 71, a motor driver (not illustrated), a platen 74, transport rollers 73, guide rollers 75, and a storage section 76. The transporting motor 71 is a drive source for transporting the recording paper P, and the motor driver drives the transporting motor 71. The platen 74 is disposed below (−Z direction in FIG. 2) the liquid discharge head 3. The transport rollers 73 are rotated when the transporting motor 71 operates. The guide rollers 75 are rotatable about the Y-axes in FIG. 2, respectively. The storage section 76 stores the recording paper P in a state in which the recording paper P is wound in a rolled state. When the ink jet printer 1 performs print processing, the transport mechanism 7 feeds the recording paper P from the storage section 76 and transports the recording paper P in the +X direction (from the upstream side toward the downstream side (hereinafter, may be referred to as a "transport direction Mv")) in the drawing along a transport path that is defined by the guide rollers 75, the platen 74, and the transport rollers 73. In the description below, as illustrated in FIG. 2, the +X direction (transport direction Mv) and the opposing −X direction are collectively referred to as the X-axis direction, the +Z direction (upward direction) and the opposing −Z direction (downward direction) are collectively referred to as the Z-axis direction, and the +Y direction that intersects the X-axis direction and the Z-axis direction and the opposing −Y direction are collectively referred to as the Y-axis direction.

To each of the 4M discharge sections D provided in the liquid discharge head 3, an ink is supplied from one of the four ink cartridges 40. Each discharge section D can store the ink supplied from the ink cartridge 40 therein and discharge the stored ink from nozzles N (see FIG. 3) that are provided in the discharge section D. Specifically, while the transport mechanism 7 transports the recording paper P on the platen 74, each discharge section D discharges the ink onto the recording paper P to form dots that constitute an image. From the 4M discharge sections D that are provided in the four head units HU in the liquid discharge head 3, the inks of four colors of CMYK are discharged, and thereby full color printing is performed.

2. Overview of Discharge Module and Discharge Section

Figure 3:
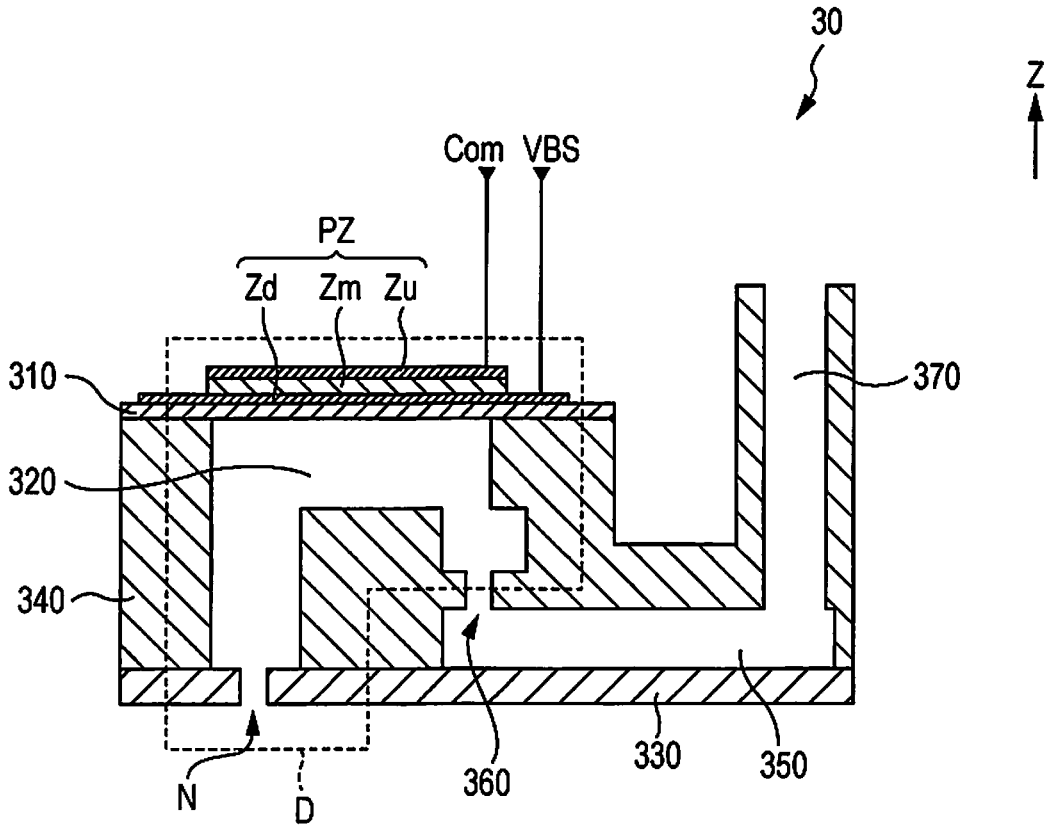
FIG. 3 illustrates a structure of a discharge section.
Figure 4:
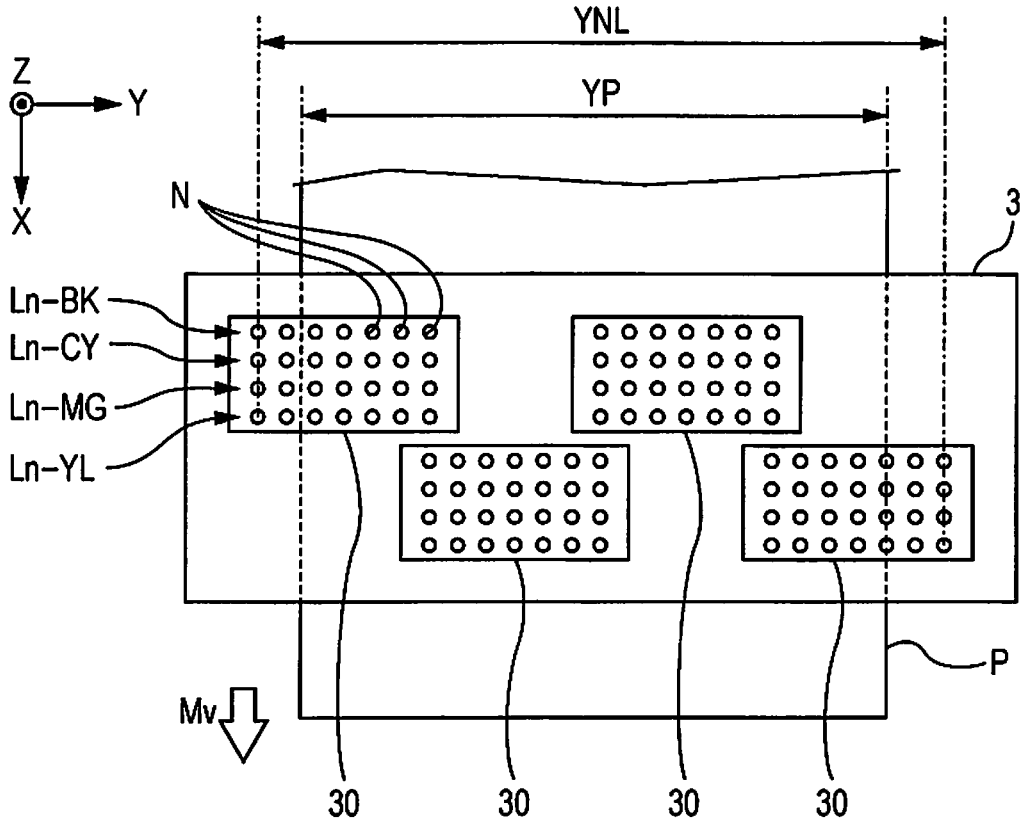
FIG. 4 is a plan view of an arrangement of nozzles on the liquid discharge head.

With reference to FIG. 3 and FIG. 4, the discharge module 30 and the discharge section D provided in the discharge module 30 will be described.

FIG. 3 is a partially sectional view schematically illustrating the discharge module 30 in which the discharge module 30 is cut such that the discharge section D is included. As illustrated in FIG. 3, the discharge section D has a piezoelectric element PZ, a cavity 320 that is filled with an ink, the nozzle N that communicates with the cavity 320, and a diaphragm 310. The cavity 320 is a space defined by a cavity plate 340, a nozzle plate 330 in which the nozzle N is formed, and the diaphragm 310. The cavity 320 communicates with a reservoir 350 via an ink supply port 360. The reservoir 350 communicates with the ink cartridge 40 that corresponds to the discharge section D via an ink inlet 370. The piezoelectric element PZ includes an upper electrode Zu, a lower electrode Zd, and a piezoelectric body Zm that is provided between the upper electrode Zu and the lower electrode Zd. The lower electrode Zd is electrically connected to a feed wire LHd (see FIG. 5) that is set to a potential VBS. When the drive signal Com is supplied to the upper electrode Zu, a voltage is applied between the upper electrode Zu and the lower electrode Zd, and thereby the piezoelectric element PZ deforms in the +Z direction or the −Z direction in accordance with the applied voltage. This embodiment uses a unimorph (monomorph) type piezoelectric element PZ as illustrated in FIG. 3. It should be noted that the piezoelectric element PZ is not limited to the unimorph type, and alternatively, a bimorph type piezoelectric element, a stacked piezoelectric element, and the like may be used. The diaphragm 310 is disposed on an upper opening of the cavity plate 340. On the diaphragm 310, the lower electrode Zd is bonded. Accordingly, when the piezoelectric element PZ is driven by the drive signal Com and deformed, the diaphragm 310 deforms. The deformation of the diaphragm 310 changes the volume of the cavity 320, and thereby the ink stored in the cavity 320 is discharged from the nozzle N. The ink in the cavity 320 that has been discharged is refilled from the reservoir 350.

FIG. 4 illustrates an example arrangement of the four discharge modules 30 in the liquid discharge head 3 and the 4M nozzles N in the four discharge modules 30 in the ink jet printer 1 viewed in the Z-axis direction from the +Z direction side in plan view. As illustrated in FIG. 4, each discharge module 30 in the liquid discharge head 3 has nozzle arrays Ln. Each nozzle array Ln includes a plurality of nozzles N that are arranged in a line so as to extend in a predetermined direction. In this embodiment, as an example, it is assumed that each discharge module 30 has four nozzle arrays Ln including a nozzle array Ln-BK, a nozzle array Ln-CY, a nozzle array Ln-MG, and a nozzle array Ln-YL. The nozzles N in the nozzle array Ln-BK are provided in the discharge section D that discharges a black ink, the nozzles N in the nozzle array Ln-CY are provided in the discharge section D that discharges a cyan ink, the nozzles N in the nozzle array Ln-MG are provided in the discharge section D that discharges a magenta ink, and the nozzles N in the nozzle array Ln-YL are provided in the discharge section D that discharges a yellow ink. Furthermore, in this embodiment, as an example, it is assumed that each of the four nozzle arrays Ln in each discharge module 30 extends in the Y-axis direction in plan view.

As illustrated in FIG. 4, the liquid discharge head 3 according to this embodiment is a so-called line head. In other words, a range YNL of the 4M nozzles N in the liquid discharge head 3 in the Y-axis direction covers a range YP of the recording paper P in the Y-axis direction when the ink jet printer 1 performs print processing onto the recording paper P (to be specific, the recording paper P that has a maximum width corresponding to a maximum width in which the ink jet printer 1 can print in the Y-axis direction).

In this embodiment, the range YP is a range that has a width of 297 mm or more. In other words, the line head (the liquid discharge head 3) in the ink jet printer 1 according to the embodiment has a size the ink jet printer 1 can perform printing onto A4-size landscape-oriented recording paper P. Furthermore, in this embodiment, it is assumed that the liquid discharge head 3 has the nozzles N that are arrayed so as to enable printing at a dot density of 600 dpi or more.

It should be noted that the arrangement of the four discharge modules 30 in the liquid discharge head 3 and the arrangement of the nozzle arrays Ln in each discharge module 30 are only examples. In each liquid discharge head 3, the discharge modules 30 and the nozzle arrays Ln may be provided in any arrangement. For example, in FIG. 4, the nozzle arrays Ln extend in the Y-axis direction; alternatively, the nozzle arrays Ln may be provided so as to extend in a predetermined direction within the XY plane. For example, the nozzle arrays Ln may be provided so as to extend in a direction different from the Y-axis direction and the X-axis direction, such as an oblique direction in the drawing. Furthermore, in FIG. 4, the four nozzle arrays Ln are provided in each discharge module 30; alternatively, one or more nozzle arrays Ln may be provided in each discharge module 30. Furthermore, in FIG. 4, the plurality of nozzles N constituting each nozzle array Ln are arranged in a line in the Y-axis direction; alternatively, positions of the even-numbered nozzles N and the odd-numbered nozzles N from the −Y side may be different from each other in the X-axis direction, that is, the nozzles N may be provided in a so-called staggered arrangement.

3. Configuration of Head Unit

Hereinafter, a configuration of each head unit HU will be described with reference to FIG. 5.

Figure 5:
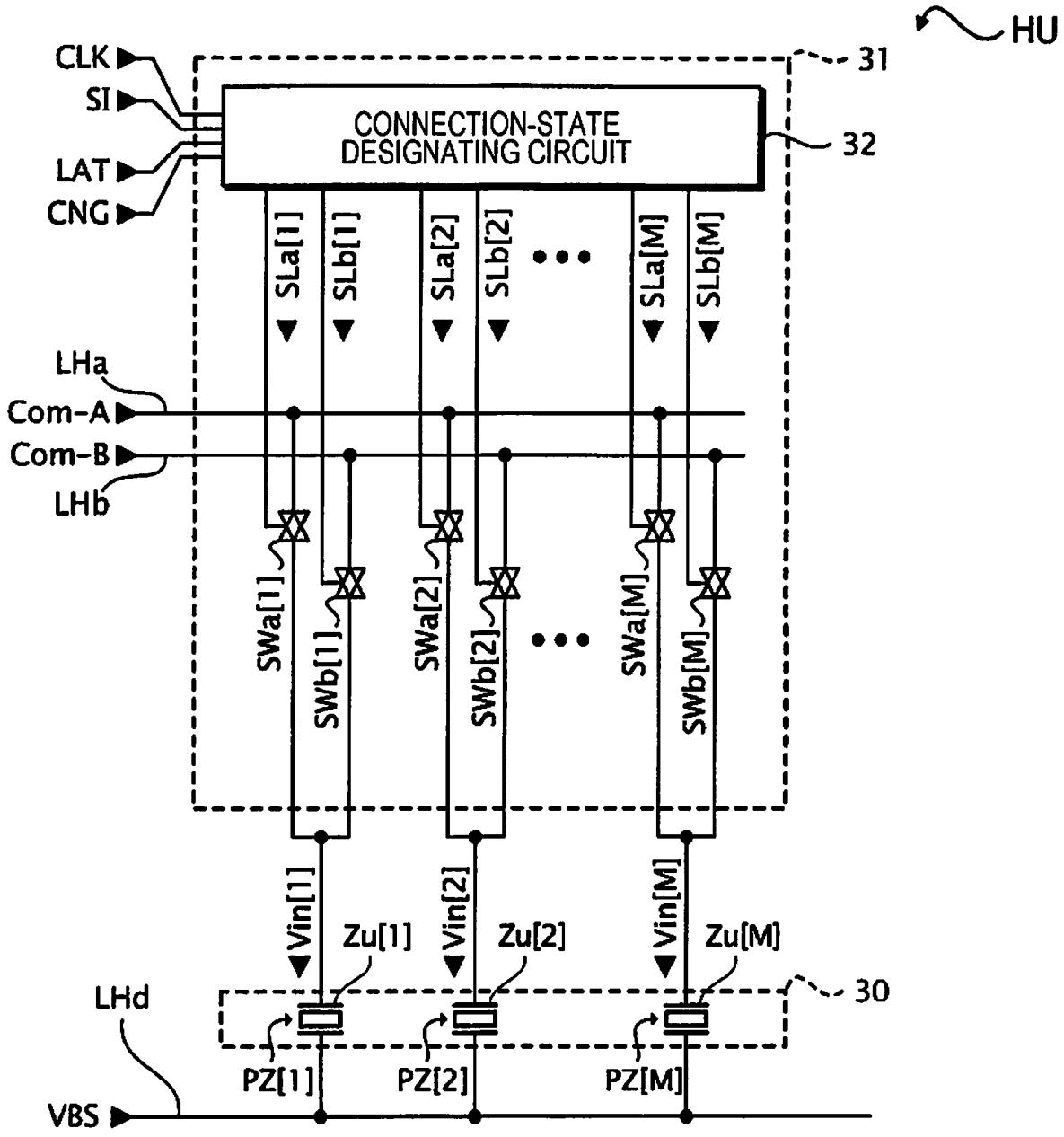
FIG. 5 is a block diagram illustrating a configuration of a head unit.

FIG. 5 is a block diagram illustrating a configuration of the head unit HU. As described above, the head unit HU includes the discharge module 30 and the drive signal supply circuit 31. The head unit HU also includes an internal wire LHa to which the drive signal Com-A is supplied from the drive-signal generation module 2, an internal wire LHb to which the drive signal Com-B is supplied from the drive-signal generation module 2, and a feed wire LHd that is set at a potential VBS.

As illustrated in FIG. 5, the drive signal supply circuit 31 includes M switches SWa (SWa[1] to SWa[M]), M switches SWb (SWb[1] to SWb[M]), and a connection-state designating circuit 32 for designating a connection state of each switch. Each switch may be, for example, a transmission gate. The connection-state designating circuit 32 generates connection-state designating signals SLa[1] to SLa[M] for designating on or off of the switches SWa[1] to SWa[M], and connection-state designating signals SLb[1] to SLb[M] for designating on or off of the switches SWb[1] to SWb[M] in accordance with the print signal SI that is supplied from the controller 6, a latch signal LAT, and a change signal CNG. The switch SWa[m] switches between conduction and non-conduction between the internal wire LHa and the upper electrode Zu[m] of the piezoelectric element PZ[m], which is provided in the discharge section D[m], in accordance with the connection-state designating signal SLa[m]. In this embodiment, as an example, it is assumed that the switch SWa[m] is turned on when the connection-state designating signal SLa[m] is at a high level and is turned off at a low level. The switch SWb[m] switches between conduction and non-conduction between the internal wire LHb and the upper electrode Zu[m] of the piezoelectric element PZ[m], which is provided in the discharge section D[m], in accordance with the connection-state designating signal SLb[m]. In this embodiment, as an example, it is assumed that the switch SWb[m] is turned on when the connection-state designating signal SLb[m] is at a high level and is turned off at a low level. In the drive signals Com-A and Com-B, a signal that is actually supplied to the piezoelectric element PZ[m] in the discharge section D[m] via the switch SWa[m] or SWb[m] may be referred to as a supply-drive signal Vin[m].

4. Operation of Head Unit

Hereinafter, operations of each head unit HU will be described with reference to FIGS. 6 to 8.

In this embodiment, an operation period of the ink jet printer 1 includes one or more unit periods Tu. In each unit period Tu, the ink jet printer 1 can perform print processing. Strictly, in each unit period Tu, in the print processing, the ink jet printer 1 can perform a process of driving each discharge section D to discharge the ink from the discharge section D. The ink jet printer 1 repeatedly performs the print processing over a plurality of continuous or intermittent unit periods Tu to discharge the ink from each discharge section D one or more times, and thereby an image represented by the print data Img is formed.

Figures 6, 7:
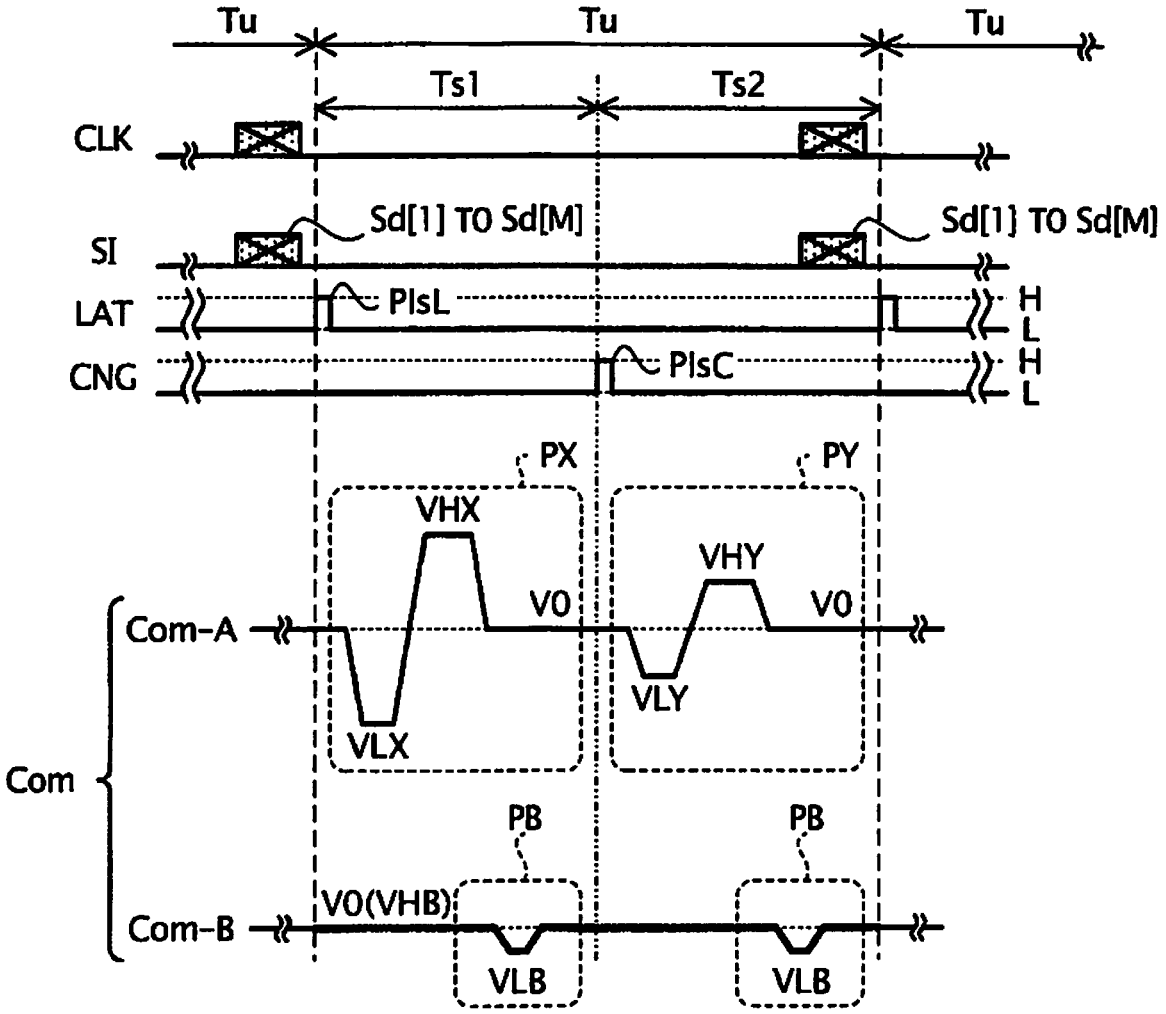
FIG. 6 is a timing chart of print processing.
FIG. 7 illustrates a relationship among print signals and connection-state designating signals.

FIG. 6 is a timing chart of operations of the ink jet printer 1 in the unit period Tu. As illustrated in FIG. 6, the controller 6 outputs the latch signal LAT that has a pulse PlsL and the change signal CNG that has a pulse PlsC. With these signals, the controller 6 defines a unit period Tu as the period from the rise of the pulse PlsL to the rise of the next pulse PlsL. The controller 6 divides the unit period Tu into a control period Ts1 and a control period Ts2 by the pulse PlsC. The print signal SI includes individual-designating signals Sd[1] to Sd[M] for designating driving modes of the discharge section D[1] to D[M] in each unit period Tu. When a print process is performed during the unit period Tu, prior to the start of the unit period Tu, the controller 6 supplies the print signal SI, which includes the individual-designating signals Sd[1] to Sd[M], to the connection-state designating circuit 32 in synchronization with the clock signal CLK as illustrated in FIG. 6. In this process, in the unit period Tu, the connection-state designating circuit 32 generates connection-state designating signals SLa[m] and SLb[m] in accordance with the individual-designating signal Sd[m].

As illustrated in FIG. 6, the drive-signal generation circuit 20 outputs the drive signal Com-A that includes a waveform PX that is provided in the control period Ts1 and a waveform PY that is provided in the control period Ts2. In this embodiment, the waveform PX and the waveform PY are determined such that the potential difference between a maximum potential VHX and a minimum potential VLX of the waveform PX is larger than the potential difference between a maximum potential VHY and a minimum potential VLY of the waveform PY. Specifically, to drive the discharge section D[m] by the drive signal Com-A having the waveform PX, the waveform of the waveform PX is determined such that the ink of an amount (medium amount) corresponding to a medium dot is discharged from the discharge section D[m]. Similarly, to drive the discharge section D[m] by the drive signal Com-A having the waveform PY, the waveform of the waveform PY is determined such that the ink of an amount (small amount) corresponding to a small dot is discharged from the discharge section D[m]. The potentials of the waveform PX and the waveform PY at the start and at the end are set to a reference potential V0. The drive-signal generation circuit 20 also outputs the drive signal Com-B that has a waveform PB provided in each of the control periods Ts1 and Ts2. In this embodiment, the waveform PB is determined such that the potential difference between a maximum potential VHB and a minimum potential VLB of the waveform PB is smaller than the potential difference between the maximum potential VHY and the minimum potential VLY of the waveform PY. Specifically, to drive the discharge section DM by the drive signal Com-B having the waveform PB, the waveform of the waveform PB is determined such that the discharge section D[m] is driven so as not to discharge the ink. The potentials of the waveform PB at the start and at the end are set to the reference potential V0. In this embodiment, the maximum potential VHB is the reference potential V0.

FIG. 7 illustrates an example of a relationship among the individual-designating signal Sd[m] and the connection-state designating signals SLa[m] and SLb[m]. As illustrated in FIG. 7, in this embodiment, the individual-designating signal Sd[m] is a 2-bit digital signal. Specifically, in each unit period Tu, the individual-designating signal Sd[m] is set to one of four values of a value (1, 1) that designates a discharge (may be referred to as a "formation of a large dot") of the ink of an amount (a large amount) corresponding to a large dot, a value (1, 0) that designates a discharge (may be referred to as a "formation of a medium dot") of the ink of a medium amount, a value (0, 1) that designates a discharge (may be referred to as a "formation of a small dot") of the ink of a small amount, and a value (0, 0) that designates a non-discharge of the ink.

When the individual-designating signal Sd[m] is set to the value (1, 1), which designates the formation of a large dot, the connection-state designating circuit 32 sets the connection-state designating signal SLa[m] to a high level in the control periods Ts1 and Ts2, and sets the connection-state designating signal SLb[m] to a low level in the control periods Ts1 and Ts2. In this case, the discharge section D[m] is driven by the drive signal Com-A having the waveform PX and discharges the middle amount of ink in the control period Ts1 and is driven by the drive signal Com-A having the waveform PY and discharges the small amount of ink in the control period Ts2. By these operations, the discharge section D[m] discharges the large amount of ink in total in the unit period Tu, and thereby the large dot is formed on the recording paper P. When the individual-designating signal Sd[m] is set to the value (1, 0), which designates the formation of a medium dot, the connection-state designating circuit 32 sets the connection-state designating signal SLa[m] to the high level in the control period Ts1 and sets to the low level in the control period Ts2, respectively, and sets the connection-state designating signal SLb[m] to the low level in the control period Ts1 and sets to the high level in the control period Ts2, respectively. In this case, the discharge section DM discharges the medium amount of ink in total in the unit period Tu, and thereby the medium dot is formed on the recording paper P. When the individual-designating signal Sd[m] is set to the value (0, 1), which designates the formation of a small dot, the connection-state designating circuit 32 sets the connection-state designating signal SLa[m] to the low level in the control period Ts1 and sets to the high level in the control period Ts2, respectively, and sets the connection-state designating signal SLb[m] to the high level in the control period Ts1 and sets to the low level in the control period Ts2, respectively. In this case, the discharge section D[m] discharges the small amount of ink in total in the unit period Tu, and thereby the small dot is formed on the recording paper P. When the individual-designating signal Sd[m] is set to the value (0, 0), which designates the non-discharge of ink, the connection-state designating circuit 32 sets the connection-state designating signal SLa[m] to the low level in the control periods Ts1 and Ts2, and sets the connection-state designating signal SLb[m] to the high level in the control periods Ts1 and Ts2. In this case, the discharge section D[m] discharges no ink in the unit period Tu, and thereby no dot is formed on the recording paper P.

Figure 8:
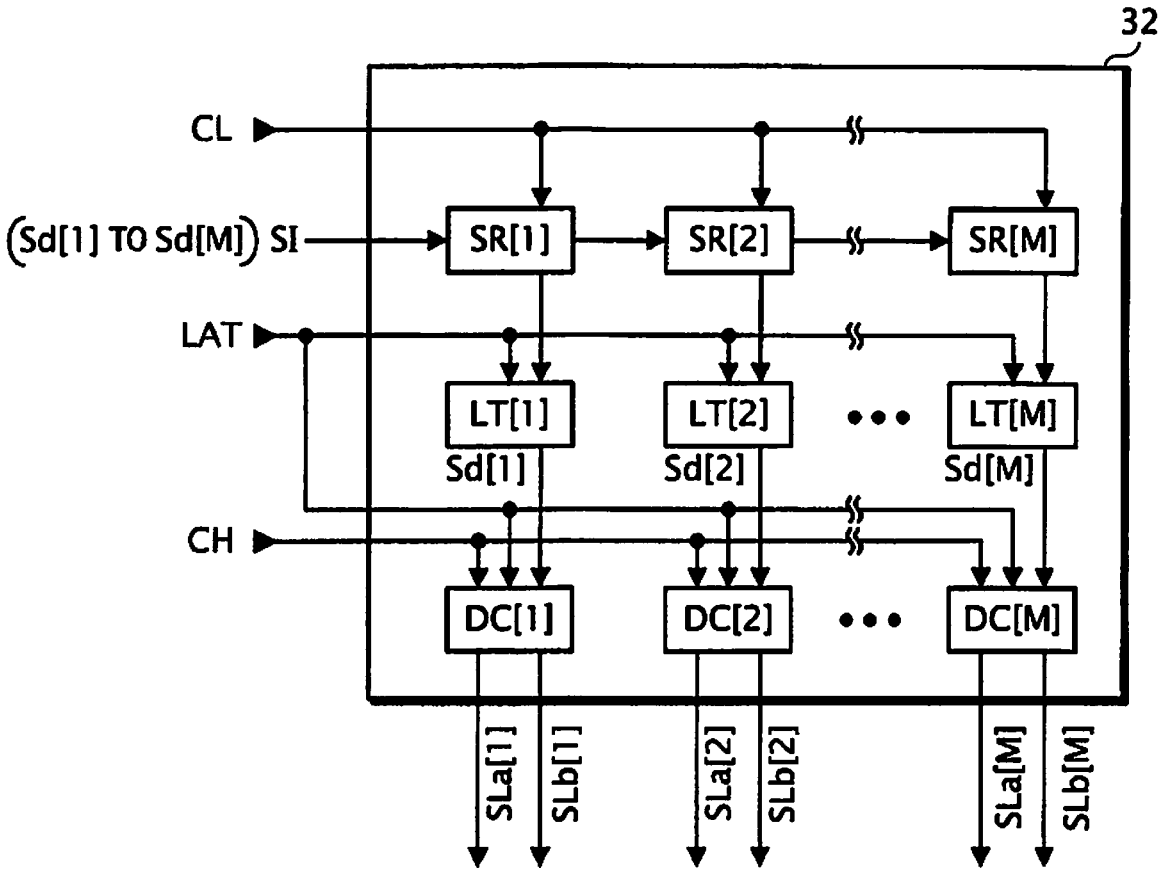
FIG. 8 is a block diagram illustrating a configuration of a connection-state designating circuit.

FIG. 8 illustrates a configuration of the connection-state designating circuit 32 according to the embodiment. As illustrated in FIG. 8, the connection-state designating circuit 32 generates the connection-state designating signals SLa[1] to SLa[M] and connection-state designating signals SLb[1] to SLb[M]. Specifically, the connection-state designating circuit 32 includes transfer circuits SR[1] to SR[M], latch circuits LT[1] to LT[M], and decoders DC[1] to DC[M] so as to correspond respectively to the discharge sections D[1] to D[M]. To the transfer circuit SR[m], the individual-designating signal Sd[m] is supplied. In FIG. 8, the individual-designating signals Sd[1] to Sd[M] are serially supplied, for example, the individual-designating signal Sd[m] corresponding to the m stage is transferred from the transfer circuit SR[1] to the transfer circuit SR[m] in the order in synchronization with the clock signal CLK. The latch circuit LT[m] latches the individual-designating signal Sd[m] supplied to the transfer circuit SR[m] when the pulse PlsL of the latch signal LAT rises to the high level. The decoder DC[m] generates the connection-state designating signals SLa[m] and SLb[m] in accordance with the individual-designating signal Sd[m], the latch signal LAT, and the change signal CNG based on the table in FIG. 7.

Figure 9:
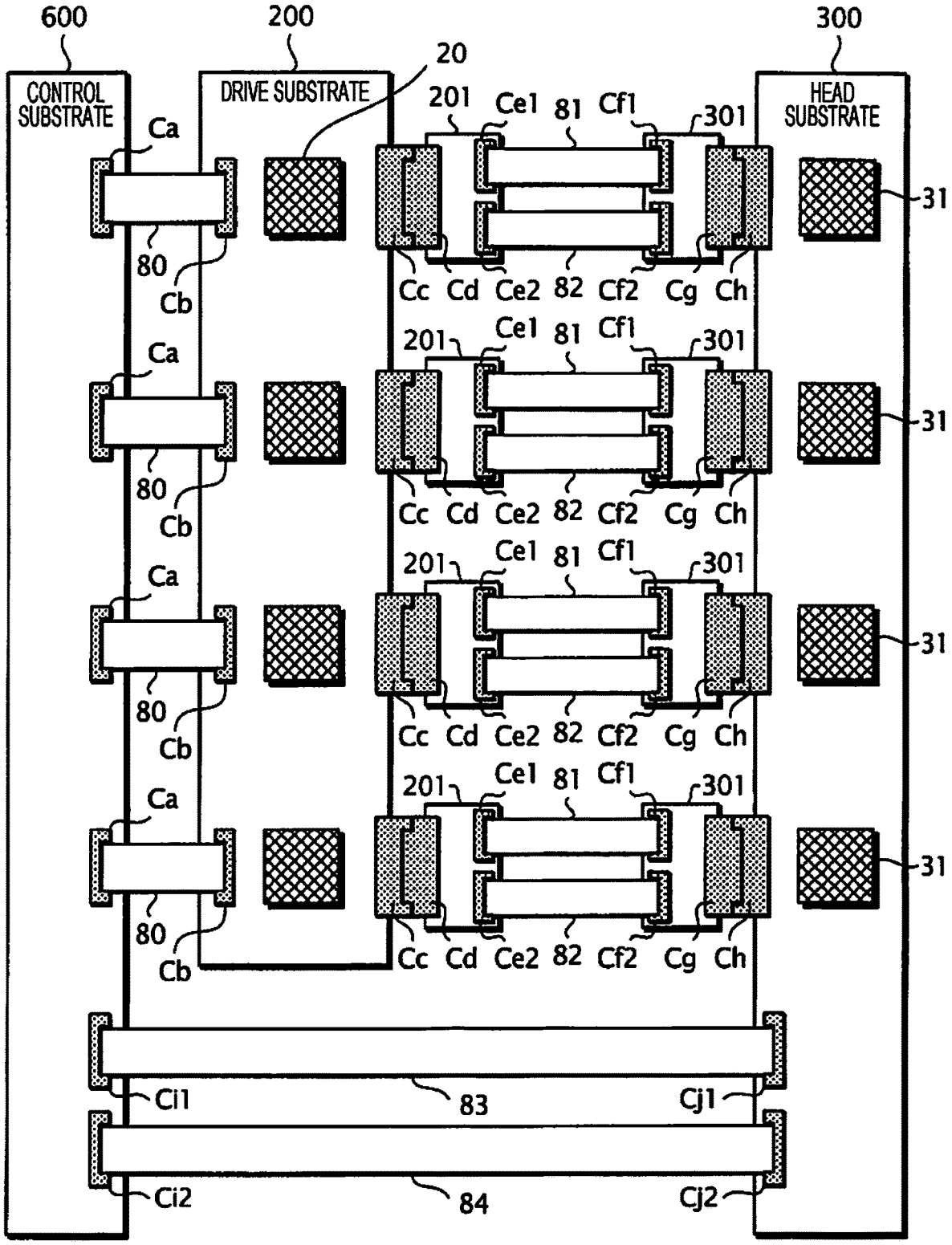
FIG. 9 illustrates connections among substrates.

5. Connection Between Drive-Signal Generation Module and Liquid Discharge Head Hereinafter, a configuration for electrical connection between the drive-signal generation module 2 and the liquid discharge head 3 will be described with reference to FIG. 9. FIG. 9 illustrates a configuration for electrical connection between the drive-signal generation module 2 and the liquid discharge head 3, a configuration for electrical connection between the controller 6 and the drive-signal generation module 2, and a configuration for electrical connection between the controller 6 and the liquid discharge head 3. In this specification, the "electrical connection" includes not only physical direct connection but also includes indirect connection via a conductive substance.

As illustrated in FIG. 9, the ink jet printer 1 includes a control substrate 600 on which the controller 6 is provided, a drive substrate 200 on which the four drive-signal generation circuits 20, which are provided in the drive-signal generation module 2, are provided, and a head substrate 300 on which the four discharge modules 30, which are provided in the liquid discharge head 3. The ink jet printer 1 further includes flexible flat cables (FFC) 80 for electrically connecting the control substrate 600 and the drive substrate 200, FFCs 81 for electrically connecting the drive substrate 200 and the head substrate 300, FFCs 82, driving-side relay substrates 201, head-side relay substrates 301, and an FFC 83 and an FFC 84 for electrically connecting the control substrate 600 and the head substrate 300.

As illustrated in FIG. 9, in this embodiment, as an example, it is assumed that the ink jet printer 1 is provided with four FFCs 80. The control substrate 600 is provided with four connectors Ca for connection to the four FFCs 80, and the drive substrate 200 is provided with four connectors Cb for connection to the four FFCs 80. One end of each FFC 80 is connected to the connector Ca and the other end is connected to the connector Cb. With this configuration, the controller 6 supplies the waveform-designating signal dCom to the drive-signal generation circuit 20 via the connector Ca, the FFC 80, and the connector Cb.

In this embodiment, as an example, it is assumed that the ink jet printer 1 includes four FFCs 81, four FFCs 82, four driving-side relay substrates 201, and four head-side relay substrates 301. The drive substrate 200 is provided with four connectors Cc for connection to the four driving-side relay substrates 201. Each driving-side relay substrate 201 is provided with a connector Cd for connection to the drive substrate 200, a connector Ce1 for connection to the FFC 81, and a connector Ce2 for connection to the FFC 82. The connector Cd on the driving-side relay substrate 201 is connected to the connector Cc on the drive substrate 200. The head substrate 300 is provided with four connectors Ch for connection to four head-side relay substrates 301. Each head-side relay substrate 301 is provided with a connector Cg for connection to the head substrate 300, a connector Cf1 for connection to the FFC 81, and a connector Cf2 for connection to the FFC 82. The connector Cg on the head-side relay substrate 301 is connected to the connector Ch on the head substrate 300. One end of each FFC 81 is connected to the connector Ce1 and the other end is connected to the connector Cf1. One end of each FFC 82 is connected to the connector Ce2 and the other end is connected to the connector Cf2.

With this configuration, the drive-signal generation circuit 20 supplies the drive signal Com to the drive signal supply circuit 31 via the connector Cc, the connector Cd, the driving-side relay substrate 201, the connector Ce1, the FFC 81, the connector Cf1, the head-side relay substrate 301, the connector Cg, and the connector Ch (hereinafter, the path is referred to as a "first path"), and supplies the drive signal Com to the drive signal supply circuit 31 via the connector Cc, the connector Cd, the driving-side relay substrate 201, the connector Ce2, the FFC 82, the connector Cf2, the head-side relay substrate 301, the connector Cg, and the connector Ch (hereinafter, the path is referred to as a "second path").

In the description below, among the drive signals Com that are supplied from the drive-signal generation circuits 20 to the drive signal supply circuits 31, the drive signals Com that are supplied to the drive signal supply circuits 31 via the first paths including the FFCs 81 are referred to as "first drive signals" and the drive signals Com that are supplied to the drive signal supply circuits 31 via the second paths including the FFCs 82 are referred to as "second drive signals". In other words, in this embodiment, each drive-signal generation circuit 20 supplies the first drive signal via the first path to the corresponding drive signal supply circuit 31 and supplies the second drive signal via the second path to the corresponding drive signal supply circuit 31. In this embodiment, the first drive signal includes the drive signal Com-A and the drive signal Com-B, and the second drive signal includes the drive signal Com-A and the drive signal Com-B. In other words, in this embodiment, it is assumed that the first drive signal and the second drive signal are the same. The invention, however, is not limited to this example, and the first drive signal and the second drive signal may be different from each other. For example, the drive-signal generation circuit 20 may supply the drive signal Com-A as the first drive signal and the drive signal Com-B as the second drive signal to the drive signal supply circuit 31.

In this embodiment, one of the connector Cc and the connector Cd is a receptacle-type connector and the other of the connector Cc and the connector Cd is a header-type connector. Furthermore, at least one of the connector Cc and the connector Cd is a connector of a floating structure. With this structure, even if a relative positional relationship changes between the FFC 81 and the drive substrate 200, between the FFC 82 and the drive substrate 200, or the like due to vibrations, or the like, the driving-side relay substrate 201 is prevented from being detached from the drive substrate 200 and the driving-side relay substrate 201 and the drive substrate 200 can be maintained in the connected state. The connector Cc and the connector Cd are connected by a two-point contact structure and the effective fitting length is 1.5 mm or more. With this structure, the electrical connection between the connector Cc and the connector Cd can be more reliably maintained. The connector Cc and the connector Cd have a plurality of pins and the current capacity per pin is 0.5 amperes or more. Consequently, a large current signal can be transmitted via the connector Cb and the connector Cd. The connector Cc and the connector Cd can be cleaned with an organic solvent detergent. Accordingly, foreign matter such as ink adhered to the connector Cc and/or the connector Cd can be readily removed.

In this embodiment, one of the connector Cg and the connector Ch is a receptacle-type connector and the other of the connector Cg and the connector Ch is a header-type connector. Furthermore, at least one of the connector Cg and the connector Ch is a connector of a floating structure. With this structure, even if a relative positional relationship changes between the FFC 81 and the head substrate 300, between the FFC 82 and the head substrate 300, or the like due to vibrations, or the like, the head-side relay substrate 301 is prevented from being detached from the head substrate 300 and the head-side relay substrate 301 and the head substrate 300 can be maintained in the connected state. The connector Cg and the connector Ch are connected by a two-point contact structure and the effective fitting length is 1.5 mm or more. With this structure, the electrical connection between the connector Cg and the connector Ch can be more reliably maintained. The connector Cg and the connector Ch have a plurality of pins and the current capacity per pin is 0.7 amperes or more. Consequently, a large current signal can be transmitted via the connector Cg and the connector Ch. The connector Cg and the connector Ch can be cleaned with an organic solvent detergent. Accordingly, foreign matter such as ink adhered to the connector Cg and/or the connector Ch can be readily removed. The connector Cg and the connector Ch are low-profile connectors that have a thickness of 5 mm or less. Accordingly, even if the ink jet printer 1 is, for example, a compact printer and has no spatial margin inside the ink jet printer 1, wiring for electrically connecting the FFC 81 and the FFC 82 to the head substrate 300 via the head-side relay substrate 301 can be provided.

In this embodiment, the control substrate 600 is provided with a connector Ci1 for connection to the FFC 83 and a connector Ci2 for connection to the FFC 84, and the head substrate 300 is provided with a connector Cj1 for connection to the FFC 83 and a connector Cj2 for connection to the FFC 84. The controller 6 can supply the drive signal supply circuit 31 with the print signal SI, the clock signal CLK, the latch signal LAT, and the change signal CNG via the connector Ci1, the FFC 83, and the connector Cj1. In this embodiment, the head substrate 300 is provided with a residual vibration detection circuit (not illustrated) and a temperature detection circuit (not illustrated). The residual vibration detection circuit detects residual vibrations generated in the discharge sections D after the discharge sections D have been driven by the drive signals Com (supply-drive signals Vin) and outputs a residual vibration signal indicating the result of the detection. The temperature detection circuit measures the temperature of the liquid discharge head 3 and outputs a temperature measurement signal indicating the result of the measurement. The residual vibration detection circuit and the temperature detection circuit can supply the controller 6 with the residual vibration signal and the temperature measurement signal via the connector Cj2, the FFC 84, and the connector Cit. In this embodiment, the controller 6 can determine whether the discharge sections D can normally discharge the inks in accordance with the residual vibration signal and can determine whether the liquid discharge head 3 is maintained at a predetermined temperature or lower in accordance with the temperature measurement signal.

6. Conclusion of Embodiment

As described above, the liquid discharge head 3 according to the embodiment is the line head that has many discharge sections D provided at high density such that printing can be made over the range YNL of 297 mm or more at a dot density of 600 dpi or more. In other words, the ink jet printer 1 according to the embodiment has more discharge sections D provided in the liquid discharge head 3 than serial printers or the like that perform print processing by reciprocating a liquid discharge head in the Y-axis direction. Although the ink jet printer 1 according to the embodiment requires a larger electric power for driving the liquid discharge head 3 than serial printers or the like, the ink jet printer 1 according to the embodiment supplies the drive signals Com for driving the liquid discharge head 3 from the drive-signal generation circuits 20 to the drive signal supply circuits 31 via the first paths including the FFCs 81 and the second paths including the FFCs 82. With this configuration, even though the liquid discharge head 3 has many discharge sections D and requires a large electric power for driving the liquid discharge head 3, the drive signals Com that are necessary for driving the liquid discharge head 3 can be supplied to the liquid discharge head 3.

In this embodiment, the FFCs 81 and the FFCs 82 are electrically connected to the head substrate 300 via the head-side relay substrates 301. In other words, in this embodiment, to attach or detaching the FFCs 81 and the FFCs 82 to or from the head substrate 300, the head-side relay substrates 301 are attached or detached to or from the head substrate 300. Accordingly, in this embodiment, the FFCs 81 and the FFCs 82 can be more readily attached or detached to or from the head substrate 300 compared with a case where the FFCs 81 and the FFCs 82 are directly attached or detached to or from the head substrate 300 respectively without the head-side relay substrates 301. Consequently, in this embodiment, the maintenance performance in repairing the liquid discharge head 3 or the like can be increased. Furthermore, in this embodiment, since attachment or detachment of the FFCs 81 and the FFCs 82 to or from the head substrate 300 is replaced by attachment or detachment of the head-side relay substrates 301 to or from the head substrate 300, compared with a case where the FFCs 81 and the FFCs 82 are directly attached or detached to or from the head substrate 300 respectively, the number of times the FFCs 81 and the FFCs 82 are actually attached or detached to or from the substrate can be reduced. As a result, deterioration and failure of the FFCs 81 and the FFCs 82 can be reduced.

Furthermore, in this embodiment, the FFCs 81 and the FFCs 82 are electrically connected to the drive substrate 200 via the driving-side relay substrates 201. In other words, in this embodiment, to attach or detaching the FFCs 81 and the FFCs 82 to or from the drive substrate 200, the driving-side relay substrates 201 are attached or detached to or from the drive substrate 200. Accordingly, in this embodiment, the FFCs 81 and the FFCs 82 can be more readily attached or detached to or from the drive substrate 200 compared with a case where the FFCs 81 and the FFCs 82 are directly attached or detached to or from the drive substrate 200 respectively without the driving-side relay substrates 201. Consequently, in this embodiment, the maintenance performance in repairing the drive-signal generation module 2 or the like can be increased. Furthermore, in this embodiment, since attachment or detachment of the FFCs 81 and the FFCs 82 to or from the drive substrate 200 is replaced by attachment or detachment of the driving-side relay substrates 201 to or from the drive substrate 200, compared with a case where the FFCs 81 and the FFCs 82 are directly attached or detached to or from the drive substrate 200 respectively, the number of times the FFCs 81 and the FFCs 82 are actually attached or detached to or from the substrate can be reduced. As a result, deterioration and failure of the FFCs 81 and the FFCs 82 can be reduced.

Furthermore, in this embodiment, the connector Cc, which is provided on the drive substrate 200 to output the first drive signal and the second drive signal, is an example of an "output connector", the FFC 81, to which the first drive signal is supplied, is an example of a "first wire", the FFC 82, to which the second drive signal is supplied, is an example of a "second wire", the driving-side relay substrate 201, which is connected to the drive substrate 200, is an example of a "relay substrate", the connector Ce1, which is provided on the driving-side relay substrate 201 and connected to the FFC 81, is an example of a "first connector", the connector Ce2, which is provided on the driving-side relay substrate 201 and connected to the FFC 82, is an example of a "second connector", and the connector Cd, which is provided on the driving-side relay substrate 201 and connected to the connector Cc on the drive substrate 200, is an example of a "relay connector".

B. Modifications

The above-described embodiment may be modified in various ways. Specific modifications will be described below. Two or more modifications selected from those below may be combined without a contradiction between them. In the modifications described below, the reference numerals used in the above description will be used to components that operate or serve similarly to those in the embodiment, and detailed descriptions of the components will be omitted.

Modification 1

In the above-described embodiment, the driving-side relay substrate 201 and the head-side relay substrate 301 are electrically connected via the two FFCs (the FFC 81 and the FFC 82); however, the invention is not limited to this example, and the driving-side relay substrate 201 and the head-side relay substrate 301 may be connected by three or more FFCs. In such a case, the drive signal Com that is necessary for driving the liquid discharge head 3 can be also supplied to the liquid discharge head 3, which requires a large electric power for driving.

Modification 2

In the above-described embodiment and modification, the components for electrically connecting the drive substrate 200 and the head substrate 300 include the driving-side relay substrate 201 and the head-side relay substrate 301; however, the invention is not limited to this example, and the components for electrically connecting the drive substrate 200 and the head substrate 300 may include at least one of the driving-side relay substrate 201 and the head-side relay substrate 301. For example, the ink jet printer 1 may omit the driving-side relay substrate 201, and the drive substrate 200 and the head substrate 300 may be electrically connected by the FFC 81, the FFC 82, and the head-side relay substrate 301. In such a case, the FFC 81 and the FFC 82 may be directly connected to a connector that is provided on the drive substrate 200. Furthermore, for example, the ink jet printer 1 may omit the head-side relay substrate 301, and the drive substrate 200 and the head substrate 300 may be electrically connected by the FFC 81, the FFC 82, and the driving-side relay substrate 201. In such a case, the FFC 81 and the FFC 82 may be directly connected to a connector that is provided on the head substrate 300.

Modification 3

In the above-described embodiment and modifications, the liquid discharge head 3 is provided with the four head units HU; however, the invention is not limited to this example, and the liquid discharge head 3 may be provided with one or more head units HU.

Furthermore, in the above-described embodiment and modifications, in the drive-signal generation module 2, the drive-signal generation circuits 20 and the head units HU correspond to each other in a one-to-one relationship; however, the invention is not limited to this example, and in the drive-signal generation module 2, two or more drive-signal generation circuits 20 may be provided for one head unit HU, or one drive-signal generation circuit 20 may be provided for two or more head units HU. For example, in the drive-signal generation module 2, for one head unit HU, two drive-signal generation circuits 20 including the drive-signal generation circuit 20 for supplying the drive signal Com-A and the drive-signal generation circuit 20 for supplying the drive signal Com-B may be provided. Alternatively, for example, in the drive-signal generation module 2, for two head units HU, one drive-signal generation circuit 20 for supplying the drive signal Com-A and the drive signal Com-B may be provided.

In the above-described embodiment and modifications, the ink jet printer 1 is provided with one or both of the driving-side relay substrate 201 and the head-side relay substrate 301 such that a pair of the FFC 81 and the FFC 82 (hereinafter, the pair is referred to as a "relay member") is provided in a one-to-one correspondence with the head unit HU; however, the invention is not limited to this example, and the ink jet printer 1 may be provided with two or more relay members for one head unit HU or one relay member for two or more head units HU.

Modification 4

In the above-described embodiment and modifications, the controller 6 is provided on the control substrate 600 and the drive-signal generation circuits 20 in the drive-signal generation module 2 are provided on the drive substrate 200; however, the invention is not limited to this example, and the controller 6 and the drive-signal generation circuits 20 may be provided on the same substrate.

As explained above, according to one application example, there is provided a liquid discharge apparatus including a liquid discharge head configured to discharge a liquid, a drive substrate provided with a drive-signal generation circuit configured to generate a first drive signal and a second drive signal for driving the liquid discharge head and an output connector configured to output the first drive signal and the second drive signal, a first wire configured to supply the first drive signal to the liquid discharge head, a second wire configured to supply the second drive signal to the liquid discharge head, and a relay substrate configured to relay the first drive signal and the second drive signal from the drive substrate to the first wire and the second wire. The relay substrate includes a relay connector configured to be connected to the output connector, a first connector configured to be connected to the first wire and configured to output the first drive signal supplied from the output connector to the relay connector to the first wire, and a second connector configured to be connected to the second wire and configured to output the second drive signal supplied from the output connector to the relay connector to the second wire.

According to this aspect of the application example, a first wire and a second wire is connected to a drive substrate by one relay connector via a relay substrate. With this structure, compared with a structure in which a first wire and a second wire are separately connected to a drive substrate by two connectors, the maintenance performance in the liquid discharge apparatus can be increased. Furthermore, according to this aspect of the application example, for example, in replacing or repairing a drive substrate, in order to detach the drive substrate from a liquid discharge apparatus and attach the drive substrate to the liquid discharge apparatus, instead of separately removing and inserting a first wire and a second wire from and into the drive substrate, a relay connector on a relay substrate and an output connector on the drive substrate are detached and attached. Consequently, according to this aspect of the application example, compared with a structure that is not provided with a relay substrate, the number of times of detaching and attaching the first wire and the second wire can be reduced. As a result, deterioration and failure of the first wire and the second wire can be reduced.

In the above-described liquid discharge apparatus, the liquid discharge head may be a line head capable of printing at a dot density of 600 dpi or more on a recording medium having a width of 297 mm or more.

A line printer that uses a line head as a liquid discharge head has more discharge sections in the liquid discharge head than a serial printer. Especially, when the discharge sections are arranged in a wide range in the liquid discharge head or printing is to be performed at a high dot density, the number of the discharge sections to be provided in the liquid discharge head increases. The many discharge sections in the liquid discharge head requires a larger electric power for driving the liquid discharge head. To solve the problem, in this structure, drive signals (a first drive signal and a second drive signal) are supplied from the drive substrate to the liquid discharge head by the first wire and the second wire. Consequently, even though a large electric power is required for driving the liquid discharge head, the liquid discharge head can be driven.

In the above-described liquid discharge apparatus, the relay connector and the output connector may be cleanable with an organic solvent detergent.

In this case, the relay connector and the output connector can be cleaned with an organic solvent detergent. Consequently, compared with a case in which the relay connector and the output connector cannot be cleaned with an organic solvent detergent, the maintenance performance in the liquid discharge apparatus can be increased.

In the above-described liquid discharge apparatus, one of the relay connector and the output connector may be a receptacle-type connector and the other of the relay connector and the output connector be a header-type connector, and one or both of the relay connector and the output connector have a floating structure.

In this case, at least one of the relay connector and the output connector has a floating structure. Consequently, even if a relative positional relationship changes among the first wire, the second wire, and the drive substrate due to vibrations, or the like, the relay connector and the output connector can be maintained in the connected state.

In the above-described liquid discharge apparatus, the relay connector and the output connector may be connected by a two-point contact structure.

In this case, the drive signal can be more reliably supplied from the output connector to the relay connector.

In the above-described liquid discharge apparatus, the relay connector and the output connector may have a current capacity of 0.5 amperes or more per pin.

In this case, even though a large electric power is required to drive the liquid discharge head, the liquid discharge head can be driven.

In the above-described liquid discharge apparatus, the relay connector and the output connector may have an effective fitting length of 1.5 mm or more.

In this case, the drive signal can be more reliably supplied from the output connector to the relay connector.

What is claimed is:

1. A liquid discharge apparatus comprising:

a liquid discharge head configured to discharge a liquid, the liquid discharge head including a head substrate;

a first wire to which a first drive signal for driving the liquid discharge head is supplied;

a second wire to which a second drive signal for driving the liquid discharge head is supplied; and a single relay substrate configured to relay the first drive signal and the second drive signal from the first wire and the second wire to the head substrate of the liquid discharge head, wherein the single relay substrate includes:

a first connector configured to be connected to the first wire;

a second connector configured to be connected to the second wire; and a relay connector configured to be connected to a head-side connector of the head substrate of the liquid discharge head, wherein the relay connector outputs, to the head-side connector:

the first drive signal supplied from the first wire to the first connector, and the second drive signal supplied from the second wire to the second connector.

2. The liquid discharge apparatus according to claim 1, wherein the liquid discharge head is a line head capable of printing at a dot density of 600 dpi or more on a recording medium having a width of 297 mm or more.

3. The liquid discharge apparatus according to claim 1, wherein one of the relay connector and the head-side connector is a receptacle-type connector and the other of the relay connector and the head-side connector is a header-type connector, and one or both of the relay connector and the head-side connector have a floating structure.

4. The liquid discharge apparatus according to claim 1, wherein the relay connector and the head-side connector are connected by a two-point contact structure.

5. The liquid discharge apparatus according to claim 1, wherein the relay connector and the head-side connector have a current capacity of 0.7 amperes or more per pin.

6. The liquid discharge apparatus according to claim 1, wherein the relay connector and the head-side connector have an effective fitting length of 1.5 mm or more.

7. The liquid discharge apparatus according to claim 1, wherein the relay connector and the head-side connector have a thickness of 5 mm or less.

8. The liquid discharge apparatus according to claim 1, wherein the relay connector is configured to be connected to a head-side connector without a wire being interposed therebetween.

9. The liquid discharge apparatus according to claim 1, wherein the liquid discharge head includes a discharge module and a drive signal supply circuit, with the drive signal supply circuit being arranged on the head substrate.

10. The liquid discharge apparatus according to claim 1, wherein one of the relay connector of the single relay substrate and the head-side connector of the head substrate is selectively inserted into and removed from the other of the relay connector of the single relay substrate and the head-side connector of the head substrate.

* * * * *